US008123433B2

(12) United States Patent
Mans

(10) Patent No.: US 8,123,433 B2
(45) Date of Patent: Feb. 28, 2012

(54) INFLATABLE LIFT SYSTEM

(76) Inventor: Timothy D. Mans, Loretto, MN (US)

( * ) Notice: Subject to any disclaimer, the term of this patent is extended or adjusted under 35 U.S.C. 154(b) by 279 days.

(21) Appl. No.: 12/539,958

(22) Filed: Aug. 12, 2009

(65) Prior Publication Data

US 2011/0038669 A1 Feb. 17, 2011

(51) Int. Cl.
*B63C 3/06* (2006.01)

(52) U.S. Cl. ..... 405/3; 405/219

(58) Field of Classification Search ..... 405/3, 203, 405/205, 219; 114/44, 45, 50, 51, 52, 54
See application file for complete search history.

(56) References Cited

U.S. PATENT DOCUMENTS 6,080,027 A * 6/2000 Rodemann ..... 441/41
6,923,133 B1 * 8/2005 Ross et al. ..... 114/45
2006/0278154 A1 * 12/2006 Towley et al. ..... 114/264
* cited by examiner

*Primary Examiner* — Tara Mayo-Pinnock
*Assistant Examiner* — Benjamin Fiorello
(74) *Attorney, Agent, or Firm* — Dave Alan Lingbeck

(57) ABSTRACT

An inflatable lift system for to lift and maneuver a boat lift upon a body of water. The inflatable lift system includes a floatation assembly including a plurality of air inflatable floatation members for lifting a movable structure, and also includes a support assembly for supporting and securing the air inflatable floatation members to the movable structure.

7 Claims, 3 Drawing Sheets

INFLATABLE LIFT SYSTEM

BACKGROUND OF THE INVENTION

1. Field of the Invention

The present invention relates to lifts and more particularly pertains to a new inflatable lift system for lifting and maneuvering a boat lift upon a body of water 2. Description of the Prior Art The use of lifts is known in the prior art. More specifically, lifts heretofore devised and utilized are known to consist basically of familiar, expected and obvious structural configurations, notwithstanding the myriad of designs encompassed by the crowded prior art which have been developed for the fulfillment of countless objectives and requirements.

The prior art includes first and second fixed-sized tubes being securely attached to opposed horizontal support beams of a boat lift and being capable of receiving volumes of air and or water. Another prior art includes a pair of air bladder enclosures having a definite size and shape being attached to the side of the boat lift. Also, another prior art includes a frame mounted pontoons. Yet, another prior art includes housings being attached about the legs of a boat lift with each housing having an air entrapment member disposed therein. While these devices fulfill their respective, particular objectives and requirements, the aforementioned patents do not disclose a new inflatable lift system.

SUMMARY OF THE INVENTION

The general purpose of the present invention, which will be described subsequently in greater detail, is to provide a new inflatable lift system which has many of the advantages of the lifts mentioned heretofore and many novel features that result in a new inflatable lift system which is not anticipated, rendered obvious, suggested, or even implied by any of the prior art lifts, either alone or in any combination thereof. The present invention includes a floatation assembly including a plurality of air inflatable floatation members for lifting a movable structure, and also includes a support assembly for supporting and securing the air inflatable floatation members to the movable structure. None of the prior art includes the combination of the elements of the present invention.

There has thus been outlined, rather broadly, the more important features of the inflatable lift system in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new inflatable lift system which has many of the advantages of the lifts mentioned heretofore and many novel features that result in a new inflatable lift system which is not anticipated, rendered obvious, suggested, or even implied by any of the prior art lifts, either alone or in any combination thereof.

Still another object of the present invention is to provide a new inflatable lift system for lifting and maneuvering a boat lift upon a body of water.

Still yet another object of the present invention is to provide a new inflatable lift system that substantially lifts the wheels of the boat lift out of the water so that the user can easily detach and attach the wheels to the boat lift.

Even still another object of the present invention is to provide a new inflatable lift system that lifts the bottom front and back supports of the boat lift above the water so that the user can attach and detach the wheels to the boat lift.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
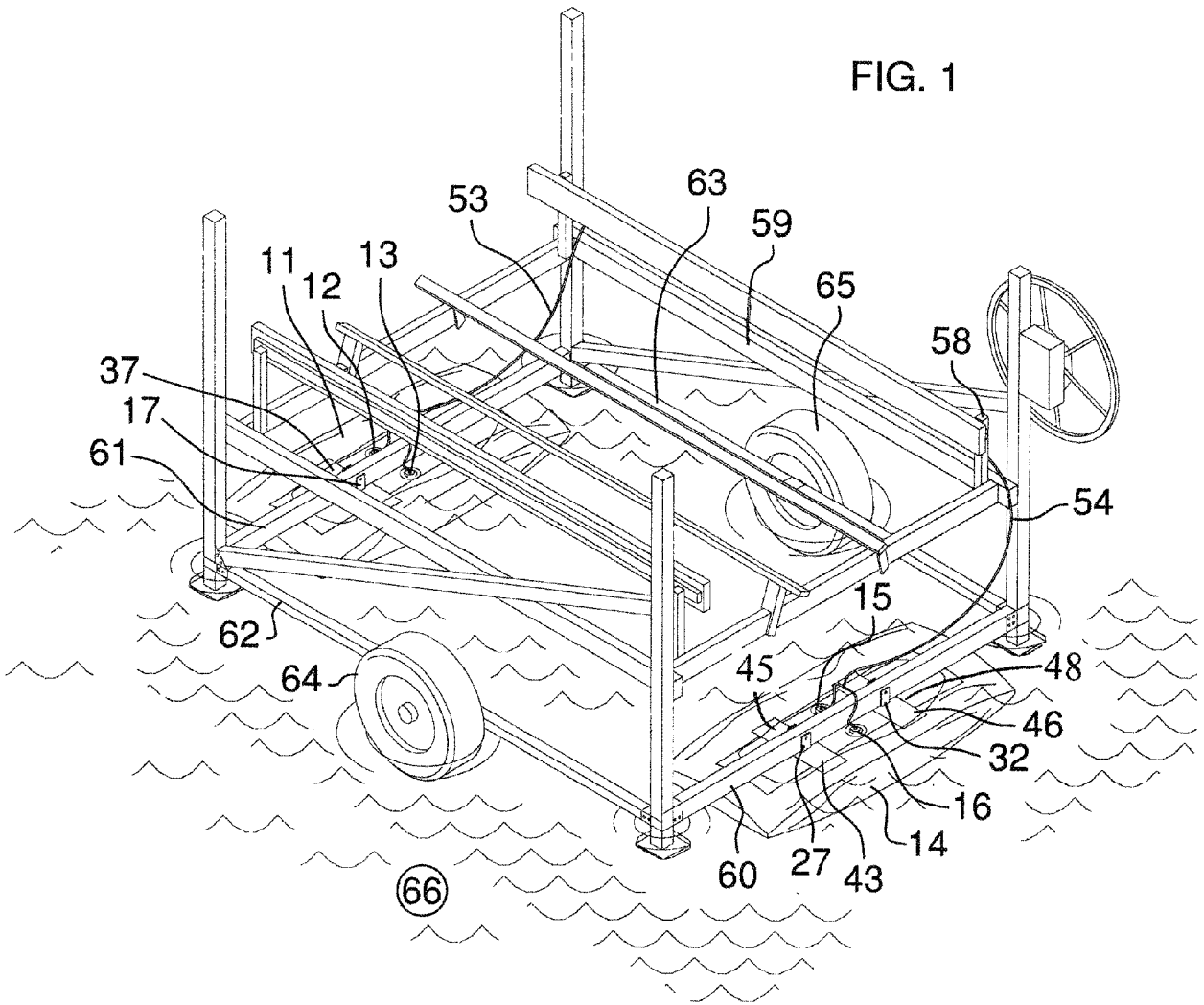
FIG. 1 is a top perspective view of a new inflatable lift system according to the present invention with the lift system being inflated to float the boat lift upon the water.
Figure 2:
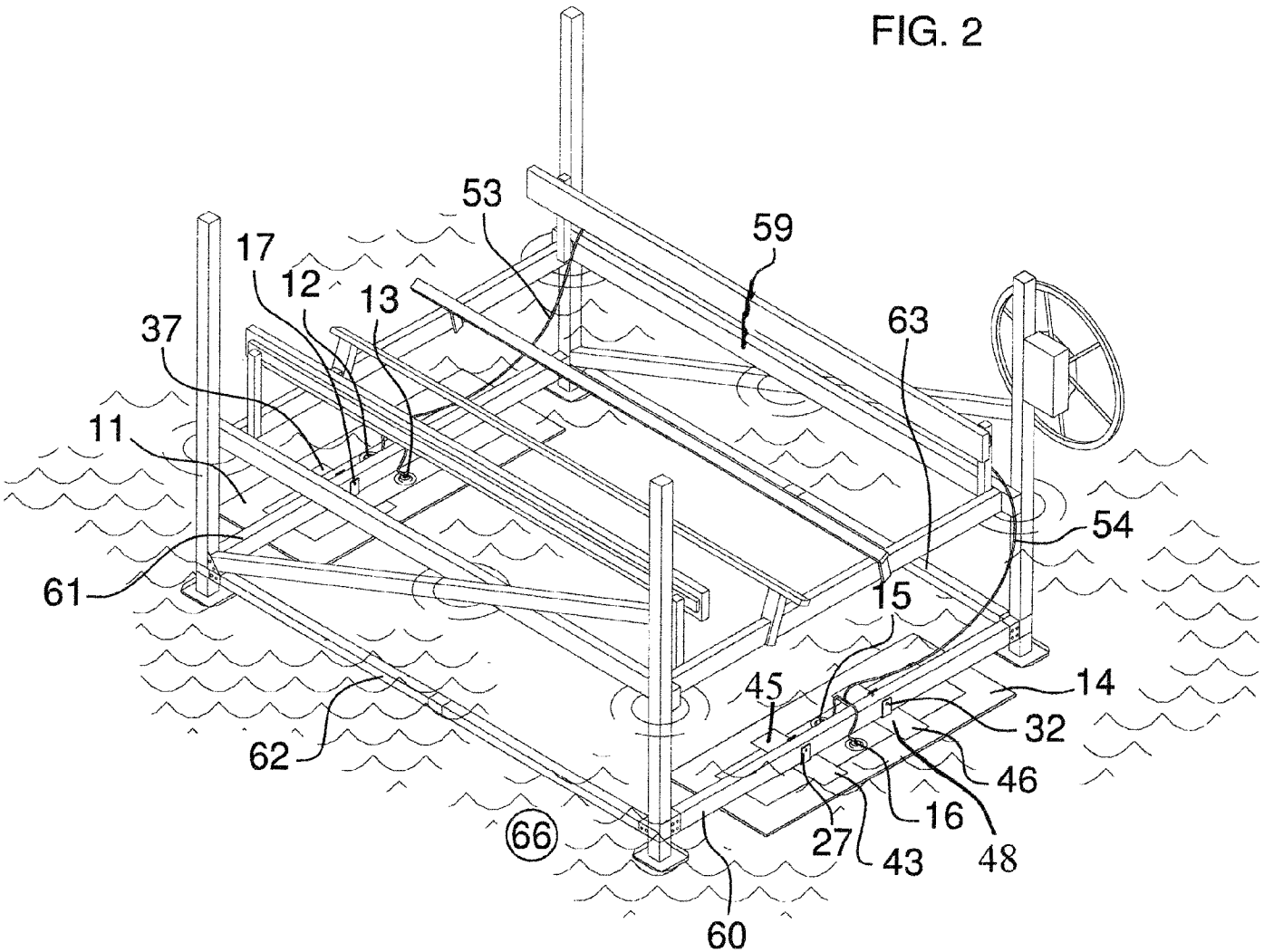
FIG. 2 is a top perspective view of the present invention with the lift system being deflated and the boat lift resting upon the bottom of a body of water.
Figure 3:
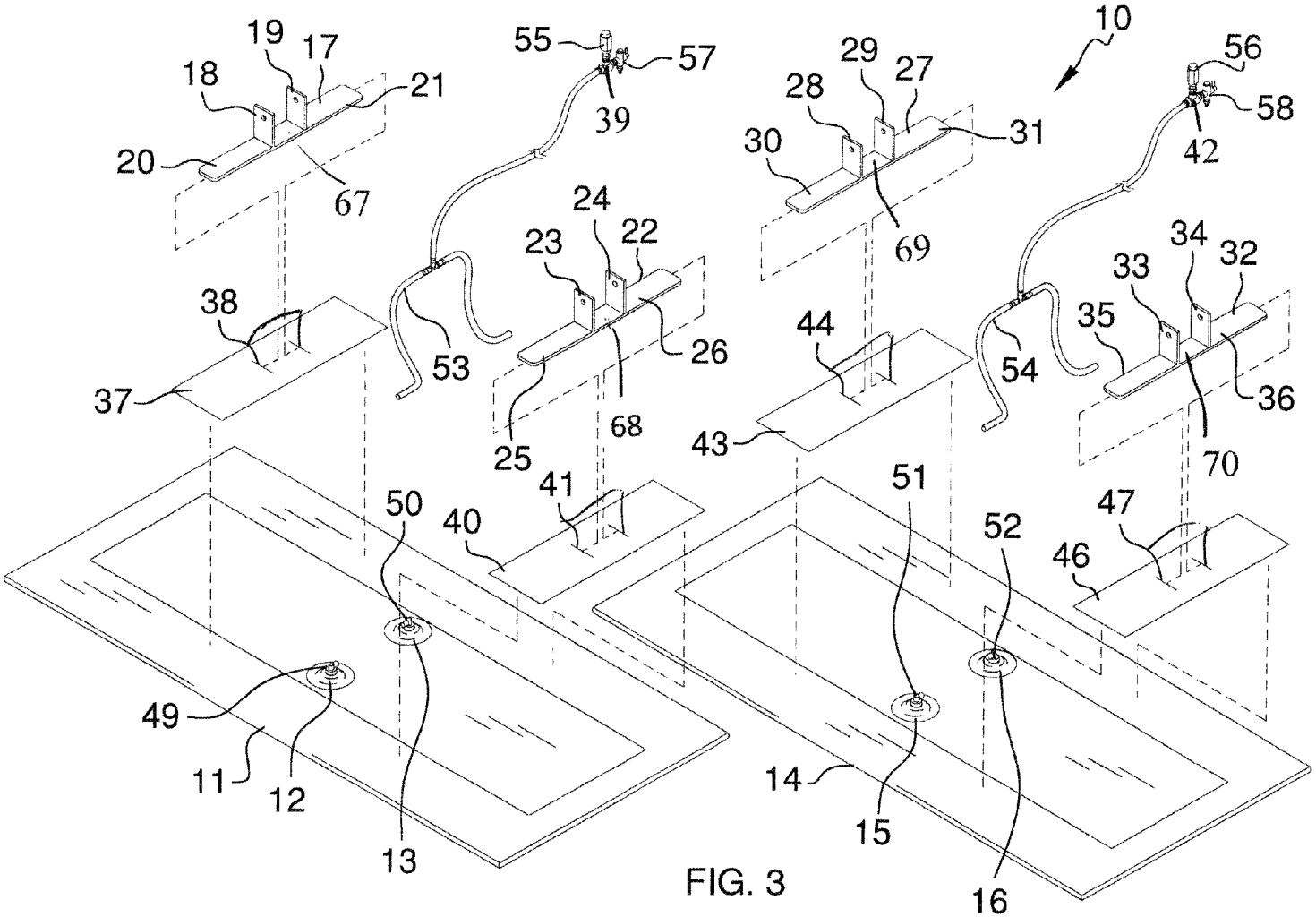
FIG. 3 is an exploded perspective view of the present invention.

With reference now to the drawings, and in particular to FIGS. 1 through 3 thereof, a new inflatable lift system embodying the principles and concepts of the present invention and generally designated by the reference numeral 10 will be described.

As best illustrated in FIGS. 1 through 3, the inflatable lift system 10 generally comprises a floatation assembly including a plurality of air inflatable floatation members 11, 14 for lifting a movable structure 59 above a, and also comprises a support assembly for supporting and securing the air inflatable floatation members 11, 14 to the movable structure 59. The air inflatable floatation members are inflatable bags 11, 14 having air-receiving chambers disposed therein. Each inflatable bag 11, 14 has a topside and also has one or more air ports 12, 13, 15, 16 being conventionally disposed therein for inflating and deflating the inflatable bags 11, 14. The inflatable bags 11, 14 are positioned under the movable structure 59 and essentially rest flat on a bottom of a body of water 66 upon the inflatable bags 11, 14 being deflated and the movable structure 59 being desirably positioned in the water 66 and stabilized upon the bottom of the water 66. The inflatable bags 11, 14 are generally rectangular shaped and are fastened and disposed longitudinally under bottom support beams 60-63 of a boat lift 59 for lifting the bottom support beams 60-63 above a surface of the water 66 upon the inflatable bags 11, 14 being inflated to expose wheels 64, 65 and/or axles of the boat lift 59 at the surface of the water 66 with the wheels 64, 65 and axles being mounted on bottom side support beams 62, 63 which are disposed perpendicular to bottom front and back support beams 60, 61. Each inflatable bag 11, 14 is centered laterally relative to a respective bottom front or back support beam 60-63 with at least a portion of an underside of a respective bottom support beam 60-63 resting upon the inflatable bag 11, 14. The floatation assembly also includes hose connectors 49-52 being conventionally disposed in the air ports 12, 13, 15, 16, and further includes hoses 53, 54 being conventionally connected to the hose connectors 49-52, and also includes valve connectors 39, 42 being conventionally connected to the hoses 53, 54, and further includes pressure relief valves 55, 56 being conventionally connected to the valve connectors 39, 42 to regulate air pressure in the inflatable bags 11, 14, and also includes air valves 57, 58 also being conventionally connected to the valve connectors 39, 42 and being connectable to an air pressurized source such as an air compressor.

The support assembly includes bracket members 17, 22, 27, 32 being fastened with bolts and wing nuts to the bottom support beams 60-63 of the boat lift 59 with the inflatable bags 11, 14 being suspended from the bracket members 17, 22, 27, 32. The support assembly includes bag support members 37, 40, 43, 46 being conventionally attached to the inflatable bags 11, 14. The bag support members 37, 40, 43, 46 are sheets of material being conventionally attached to the topsides of the inflatable bags 11, 14. The sheets of material form pockets 45, 48 in cooperation with the inflatable bags 11, 14 and have slits 38, 41, 44, 47 being disposed therethrough into the pockets 45, 48. Each bracket member 17, 22, 27, 32 has a U-shaped portion for fastening to a respective bottom support beam 60-63 and also has an anti-roll tongue portion 20, 21, 25, 26, 30, 31, 35, 36 integrally extending from the U-shaped portion and being securely inserted through the slit 38, 41, 44, 47 of a respective bag support member 37, 40, 43, 46 and into a respective the pocket 45, 48 for supporting, engaging and preventing rolling of a respective inflatable bag 11, 14 about a respective bottom support beam 60-63. The U-shaped portion includes a bottom portion 67, 68, 69, 70 and side portions 18, 19, 23, 24, 28, 29, 33, 34, being angled relative to the bottom portion 67, 68, 69, 70 with the side portions 18, 19, 23, 24, 28, 29, 33, 34 being spaced apart to allow a respective bottom front or back support beam 60, 61 to be received therebetween. The anti-roll tongue portion 20, 21, 25, 26, 30, 31, 35, 36 is integrally attached to and in planar alignment with the bottom portion 67, 68, 69, 70 of the U-shaped portion and is generally perpendicular to the side portions 18, 19, 23, 24, 28, 29, 33, 34 of the U-shaped portion to support a respective inflatable bag 11, 14 and to urge and engage the inflatable bag 11, 14 substantially under a respective bottom front or back support beam 60, 61 upon the inflatable bag 11, 14 being inflated to lift the respective bottom or back support beam 60, 61 above the surface of the water 66 to expose wheels 64, 65 and/or axles of the boat lift 59 at the surface of the water 66. Each bracket member 17, 22, 27, 32 includes anti-roll tongue portions 20, 21, 25, 26, 30, 31, 35, 36 extending in opposite directions from the U-shaped portion and being securely inserted through the slits 38, 41, 44, 47 and into respective the pockets 45,48 to prevent rolling of a respective inflatable bag 11, 14 about a respective bottom front or back support beam 60, 61.

In use, the conventional air pressurized source is conventionally connected to the air valves 57, 58 and pressurized air is passed through the hoses 53, 54 and into the inflatable bags 11, 14. Approximately 1 to 3 pounds of air pressure is sufficient to inflate the inflatable bags 11, 14 and raise the boat lift 59 out of the water 66. Since the inflatable bags 11, 14 are positioned under the boat lift 59, in particular under the bottom front and back support beams 60, 61, the boat lift is generally raised above the surface of the water 66 thus exposing the wheels 64, 65 and/or axles on the boat lift 59 at the surface of the water 66. Since the wheels 64, 65 are used to move the boat lift 59 from the shore and into the water 66 and since the wheels 64, 65 are typically removed because the boat lift 59 is intended to remain in the water 66 for a period time, it is desirable to stabilize the boat lift 59 and protect the wheels 64, 65 from being damaged from the water 66 by removing the wheels 64, 65. If the boat lift 59 was only partially set afloat in the water 66 with much of the frame and wheels 64, 65 being disposed under the surface of the water 66, it would be difficult for the user to remove the wheels 64, 65 and then subsequently remount the wheels 64, 65 back on the boat lift 59. Once the boat lift 59 is moved to the desired position in the water 66, the inflatable bags 11, 14 are deflated by air valves 57, 58 and the boat lift 59 drops and settles in the water 66 and upon the bottom with the inflatable bags 11, 14 being generally flattened and the bottom front and back support beams 60, 61 resting not only on the bottom of the water 66 but also on the inflatable bags 11, 14. When it is time to remove the boat lift 59 from the water 66, the pressurized air source is connected to the air valves 57, 58 and pressurized air is passed into the inflatable bags 11, 14. The inflatable bags 11, 14 need to be positioned under the bottom front and back support beams 60, 61 so that the boat lift 59 can be raised and floated above the surface of the water 66 so that the wheels 64, 65 and axles are exposed at the surface of the water 66.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the inflatable lift system. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An inflatable lift system comprising:

a floatation assembly including a plurality of air inflatable floatation members for lifting a movable structure, said air inflatable floatation members being inflatable bags each having a topside and also having one or more air ports disposed therein for inflating and deflating said inflatable bags, said inflatable bags being positioned under the movable structure and essentially rest flat on a bottom of a body of water upon said inflatable bags being deflated and the movable structure being desirably positioned in the water and stabilized upon the bottom of the water and upon said inflatable bags, said inflatable bags being fastened and disposed under bottom support beams of a boat lift for lifting the support beams above a surface of the water upon said inflatable bags being inflated to expose wheels and/or axles of the boat lift at a surface of the water; and a support assembly for supporting and securing said air inflatable floatation members to the movable structure, said support assembly including bracket members being fastened to the bottom support beams of the boat lift for supporting said inflatable bags, said support assembly including bag support members being attached to said inflatable bags, said bag support members being sheets of material being attached to said topsides of said inflatable bags, said sheets of material forming pockets in cooperation with said inflatable bags.

2. The inflatable lift system as described in claim 1, wherein each said bracket member has a U-shaped portion for fastening to a respective bottom support beam and also has an anti-roll tongue portion extending from said U-shaped portion and being securely inserted through said slit of a respective said bag support member and into a respective said pocket for supporting, engaging and preventing rolling of a respective said inflatable bag about the respective bottom support beam.

3. The inflatable lift system as described in claim 2, wherein said U-shaped portion includes a bottom portion and side portions angled relative to said bottom portion with said side portions being spaced apart to allow a respective bottom front or back support beam to be received therebetween.

4. The inflatable lift system as described in claim 3, wherein said anti-roll tongue portion is integrally attached to and in planar alignment with said bottom portion of said U-shaped portion and is generally perpendicular to said side portions of said U-shaped portion to support a respective said inflatable bag and to urge and engage said inflatable bag substantially under a respective bottom front or back support beam upon said inflatable bag being inflated to lift the respective bottom or back support beam above the surface of the water to expose wheels and/or axles of the boat lift.

5. The inflatable lift system as described in claim 4, wherein each said bracket member includes anti-roll tongue portions extending in opposite directions from said U-shaped portion and being securely inserted into respective said pockets to prevent rolling of a respective said inflatable bag about a respective bottom front or back support beam.

6. A method of maneuvering a boat lift in a body of water comprises the steps of:

providing inflatable bags being secured to and disposed under a boat lift, disposing the inflatable air bags under bottom support beams and generally centering the inflatable bags relative to the bottom support beams, and providing bracket members being fastened to the bottom front and back support beams and having anti-roll tongue portions;

inflating the inflatable bags with pressurized air to lift the boat lift out of the water, inflating the inflatable bags to lift bottom front and back support beams above the surface of the water to expose wheels of the boat lift at the surface of the water;

removing wheels of the boat lift and positioning the boat lift in the water; and releasing the air from the inflatable bags to lower and stabilize the boat lift in the water.

7. The method of maneuvering a boat lift in a body of water as described in claim 6, wherein the step of inflating the inflatable bags further includes inflating the inflatable bags whereupon the anti-roll tongue portions keep the inflatable bags under the bottom front and back support beams.

* * * * *